US006152356A

United States Patent [19]

Minden

[11] Patent Number: 6,152,356

[45] Date of Patent: Nov. 28, 2000

[54] HYDRAULIC MINING OF TAR SAND BITUMEN WITH AGGREGATE MATERIAL

[76] Inventor: Carl S. Minden, 314 Federal Heights Cir., Salt Lake City, Utah 84103

[21] Appl. No.: 09/274,949

[22] Filed: Mar. 23, 1999

[51] Int. Cl.[7] ..... E21C 25/60

[52] U.S. Cl. ..... 229/17; 299/6; 299/8; 175/54; 175/67

[58] Field of Search ..... 299/3, 6, 16, 17, 299/8; 175/54, 67

[56] References Cited

U.S. PATENT DOCUMENTS

| | | | |
|---|---|---|---|
| 2,349,062 | 5/1944 | Uren | 166/278 |
| 2,708,567 | 4/1955 | Hildebrandt | 175/54 |
| 3,951,457 | 4/1976 | Redford . | |
| 4,114,687 | 9/1978 | Payton . | |
| 4,124,074 | 11/1978 | Allen et al. . | |
| 4,212,353 | 7/1980 | Hall . | |
| 4,311,596 | 1/1982 | Gleim . | |
| 4,406,499 | 9/1983 | Yildirim . | |
| 4,437,706 | 3/1984 | Johnson . | |
| 4,459,200 | 7/1984 | Dente et al. . | |
| 4,728,152 | 3/1988 | Pike et al. . | |
| 5,249,844 | 10/1993 | Gronseth . | |
| 5,316,664 | 5/1994 | Gregoli et al. . | |
| 5,340,467 | 8/1994 | Gregoli et al. . | |

*Primary Examiner*—Eileen D. Lillis
*Assistant Examiner*—John Kreck
*Attorney, Agent, or Firm*—Thorpe, North & Western LLP

[57] ABSTRACT

A method and apparatus for the hydraulic removal of bitumen from a tar sand deposit comprises forming a borehole into the tar sand deposit and securing a casing into the borehole. Into the casing is inserted a mining tool having a water/diluent channel and a slurry exit channel. Through the casing the borehole is charged with crushed aggregate. At the lower end of the tool are nozzles through which high pressure hot water/diluent is injected as a jet from the water/diluent channel into the tar sand deposit causing a cavity to form in the tar sand deposit. The heat of the water/diluent jets and dissolving action of the diluent softens the tar sand contacted and the impact of the jets and the scouring action of the aggregate, as impinged upon by the jets, removes the tar sand from the surface of the developing cavity into a water phase. A bitumen/diluent phase rises to the surface of the water phase and is removed from the cavity through the casing. A water sand slurry at the bottom of the developing cavity is removed from the slurry exit channel where sand is subsequently removed and the water is recovered and reintroduced back into the process along with makeup water and diluent. Water temperature and pressures are controlled to optimize the hydraulic mining process.

20 Claims, 8 Drawing Sheets

HYDRAULIC MINING OF TAR SAND BITUMEN WITH AGGREGATE MATERIAL

BACKGROUND OF THE INVENTION 1. The Field of the Invention.

The present invention relates generally to the mining of petroleum hydrocarbons from petroleum bearing formations. More particularly, this invention concerns the hydraulic mining of bitumen from tar sand formations that are either found too deep or of insufficient thickness to be mined economically by surface mining techniques. 2. The Background Art.

Petroleum is generally recovered by penetrating reservoirs with wells. When a well is drilled, the petroleum either flows to the surface by means of natural pressure or by pumping. However, there are many reservoirs which contain petroleum that is too viscous to be produced by conventional methods. Under these circumstances, different methods of extraction must be used.

One of the most viscous petroleum deposits is in tar sand deposits that are commonly found in the Western United States, Western Canada and Venezuela. These tar sand deposits contain significant amounts of bituminous petroleum. However, conventional well drilling techniques are ineffective in recovering bitumen from tar sands.

As a result, other methods of recovering bitumen from tar sands have been developed. One of the earliest methods used for recovering bitumen was surface mining. Surface mining is the process of removing the overburden from the surface so that the tar sands can be removed from an open pit. The overburden is typically removed by large-scale mining equipment.

Once the tar sands deposits are reached, the tar sand material is recovered by mechanical means and removed for later processing and extraction of the bitumen. Standard processing methods utilize hot water with or without hydrocarbon diluents or chemical additives to decrease the viscosity of the bitumen and separate it from the inorganic tar sand solids. Once the bitumen is separated from the tar sand the bitumen, being less dense than water, will rise to the surface of the water from which it is easily separated. The bitumen depleted sand material sinks in the water by the force of gravity.

As is well known in the art, there are a host of disadvantages with surface mining methods. First, surface mining is not economical in many cases. Surface mining is generally limited to areas in which the overburden is minimal and the tar sand formation is relatively thick so that efficient and economic removal of the tar sand is possible. As the ratio of overburden to tar sand increases, surface mining becomes less economic. Furthermore, surface mining creates significant expense associated with reclaiming the mined region and disposing of tailings that result from the processing and extraction of the bitumen. Unfortunately, most tar sand is at such a depth that it is not economic to remove the tar sand through surface mining. Where the overburden is too thick for economic removal through surface mining techniques, other mining methods must be used.

In an attempt to avoid the disadvantages associated with surface mining, other methods of bitumen recovery have been developed. One primary method is known as in-situ processing. In-situ processing methods separate the bitumen from the tar sand formation within the formation such that only the bitumen is pumped to the surface. Under these methods the bitumen depleted or lean sand material remains in the mined cavity to prevent subsidence.

Most in-situ methods generally begin by drilling a borehole through the overburden and completely through to the bottom of the tar sand formation. Once a borehole is drilled, the mining apparatus is inserted and the mining operation is begun. The mining operation typically begins by delivering heated jets of water into the tar sand formation. This process causes the formation to liquify into a slurry consisting of sand, water and bitumen.

Most in-situ methods do not pump the slurry material to the surface for processing. Rather, in-situ methods attempt to process and separate the bitumen from the tar sand formation in the mining cavity directly, then pump only the bitumen to the surface. The sand and other materials remain in the ground.

There are a variety of in-situ methods that have evolved in the art. One method known as a thermal method typically injects hot water or steam into the formation causing the bitumen to separate from the sand particles. Hot water is pumped into the borehole and delivered at a high velocity into the formation thereby causing the formation to erode and form a cavity. The thermal energy in the hot water raises the temperature of the formation thereby assisting in the erosion process and the separation of bitumen from the sand material. The bitumen tends to float to the surface of the heated water, which accumulates in the cavity. The bitumen then is pumped out and the remainder of the slurry material remains in the cavity.

Methods that solely rely on heat to erode the formation and cause the separation of the bitumen are generally regarded as inefficient. The size of a cavity in which effective bitumen/sand separation can be achieved is limited. As a result, the cost per unit of the bitumen recovered is very high.

While the use of solvent and chemical additives may make the erosion and separation processes more efficient, thereby reducing the costs for bitumen removal, these savings are offset by the added costs of the solvent and chemical additives as well as added processing steps. While some of the solvents or chemicals can be recycled and reused, there are additional costs associated with recycling. Furthermore, recycling is not perfectly efficient as some solvents or chemicals are lost and must be replaced.

Many in-situ methods also require the use of gases to maintain pressure within a mining cavity. As is well known in the art, when an underground cavity is mined there is always a danger that the overburden will collapse into the cavity. As a result, methods have been developed to prevent such a collapse. Unfortunately many of these methods require that a gas be introduced into the cavity at sufficient pressure to prevent the overburden from collapsing. Any time gas is used, there are additional risks and dangers associated with the containment of said gas or the possibility of explosion.

A typical example of in-situ methods is disclosed in U.S. Pat. No. 4,406,499 issued Yildirim (hereinafter referred to as "Yildirim"). Yildirim discloses a method that requires the drilling of a borehole through the overburden to the bottom of a tar sand deposit. A water jet means is inserted to the bottom of the deposit. The water is injected into the tar sand in order to create a slurry in the bottom of the cavity. The water jets are raised through the tar sand thereby filling the cavity with a slurry material until the top of the tar sand formation is reached.

Once the top is reached, the water jet apparatus is removed and a separate apparatus comprising a system of small pipes is introduced to the bottom of the slurry mixture.

Hot water is introduced into the slurry through the pipes which percolates upwardly through the slurry causing the bitumen to separate. The bitumen is collected at the top of the cavity and then is piped out. The invention disclosed in Yildirim requires that gas be injected into the cavity for purposes of maintaining a sufficient pressure within the cavity to prevent the overburden from collapsing.

Due to the problems associated with surface mining and in-situ mining techniques, hydraulic mining methods have been proposed as alternatives. Typically, hydraulic methods inserting an apparatus having nozzles into a borehole that has been drilled through an overburden to a tar sand formation and injecting jets of water into the sand formation. As in the in-situ methods, the water jets are injected into the formation thereby creating a slurry material to form in the cavity. The slurry material is then transported by pipeline to the surface for processing and removal of the bitumen. Once the bitumen is removed from the slurry and once the mining site is exhausted the sand and other material may be returned to fill in the resulting cavity to prevent subsidence. Hydraulic methods of mining also typically utilize gas to maintain sufficient pressure within the cavity during the mining operation to avoid subsidence problems.

The method disclosed in U.S. Pat. No. 5,249,844 issued to Gronseth (hereinafter referred to as "Gronseth") is typical of hydraulic methods of mining. Gronseth discloses a hydraulic method of mining that requires the drilling of a borehole into a tar sand reservoir. A casing is inserted within the borehole that extends through the overburden. A tubing with a water nozzle at its end is inserted into the borehole. Water is caused to flow through the tubing where it is emitted radially from nozzles. The emitted water causes the erosion of the tar sand formation, causing the sand particles and heavy oil to create a slurry. The resulting slurry is caused to flow upwardly through a second tubing to the surface for processing. After the cavity has been mined to its limit and the bitumen has been removed from the slurry, the oil depleted sand material is returned to he cavity.

However, existing hydraulic methods have many disadvantages similar to those of in-situ methods. For example, hydraulic methods suffer from the same inefficiencies associated with heating the fluid and using chemical additives. Hydraulic methods are also inefficient since the slurry material is pumped twice; once to the surface for processing and again back into the cavity when the mining in that cavity is completed. Hydraulic methods also require additional facilities to store slurry material while the cavity is being mined and while the bitumen is being separated. These inefficiencies make hydraulic mining not only more time consuming but more costly as well.

Also, most hydraulic and in-situ methods rely heavily on high pressure water jets to erode the tar sand formation to separate the bitumen. As those in the art can appreciate, as the tar sand formation is eroded and the distance from the water jets is increased, there is a significant decrease in force associated with the jets of water. Problems of water jet force are compounded as the mining cavity is filled with water. If the jets of water travel through a water medium the jet force is continuously reduced.

There have been attempts to overcome this problem. For example, in U.S. Pat. No. 4,437,706 issued to Johnson (hereinafter referred to as "Johnson") there is disclosed a method of mining that introduces high velocity jets of water into a cavity formation for purposes of causing the tar sand material to erode and cause the bitumen to separate from the tar sand. The apparatus in Johnson attaches the jet nozzles to a flexible tube that can be configured into various positions to produce a well or cavity of desired proportions. However, the primary purpose for the flexible tube is that it provides a method of keeping the jets in a very close proximate relationship to the formation so that the force of the jet of water on the formation can be maintained.

However, as those in the art can appreciate, this design has many disadvantages namely it is difficult, if not practically impossible, to configure and flex the tube once it is in a formation. The only way to reconfigure the tube is to stop the mining operation and withdraw the tube from the cavity in order to make the desired adjustment. This method is difficult to implement and inefficient.

There is a need for an hydraulic mining apparatus and method to overcome the limitations and inefficiencies in the prior art. Specifically, there is a need for an apparatus and method that provides a more cost effective and efficient erosion process. An apparatus and method is needed that does not rely solely on jets of heated fluid and chemical additives to cause erosion of the tar sand and separation of the bitumen.

3. Objects of the Invention

It is therefore an object of the present invention to provide a hydraulic mining apparatus and process which is simple in design and manufacture.

It is a further object of the present invention to provide an apparatus and process for hydraulically mining tar sand deposits and recovering the bitumen therefrom in an efficient and economic manner.

It is a further object of the present invention to provide an apparatus and process for hydraulically mining bitumen from tar sand formations that utilizes aggregate added to the deposit being mined as a scouring agent thereby permitting the efficient use of high pressure water and thermal energy for mining tar sand formations.

It is a further object of the present invention to provide for an apparatus and process for hydraulically mining bitumen from tar sand formations that will allow one formation to be mined while simultaneously reclaiming a second formation with bitumen depleted sand.

Additional objects and advantages of the invention will be set forth in the description which follows, and in part will be apparent from the description, or may be learned by the practice of the invention without undue experimentation. The objects and advantages of the invention may be realized and obtained by means of the apparatus, methods and combinations as particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
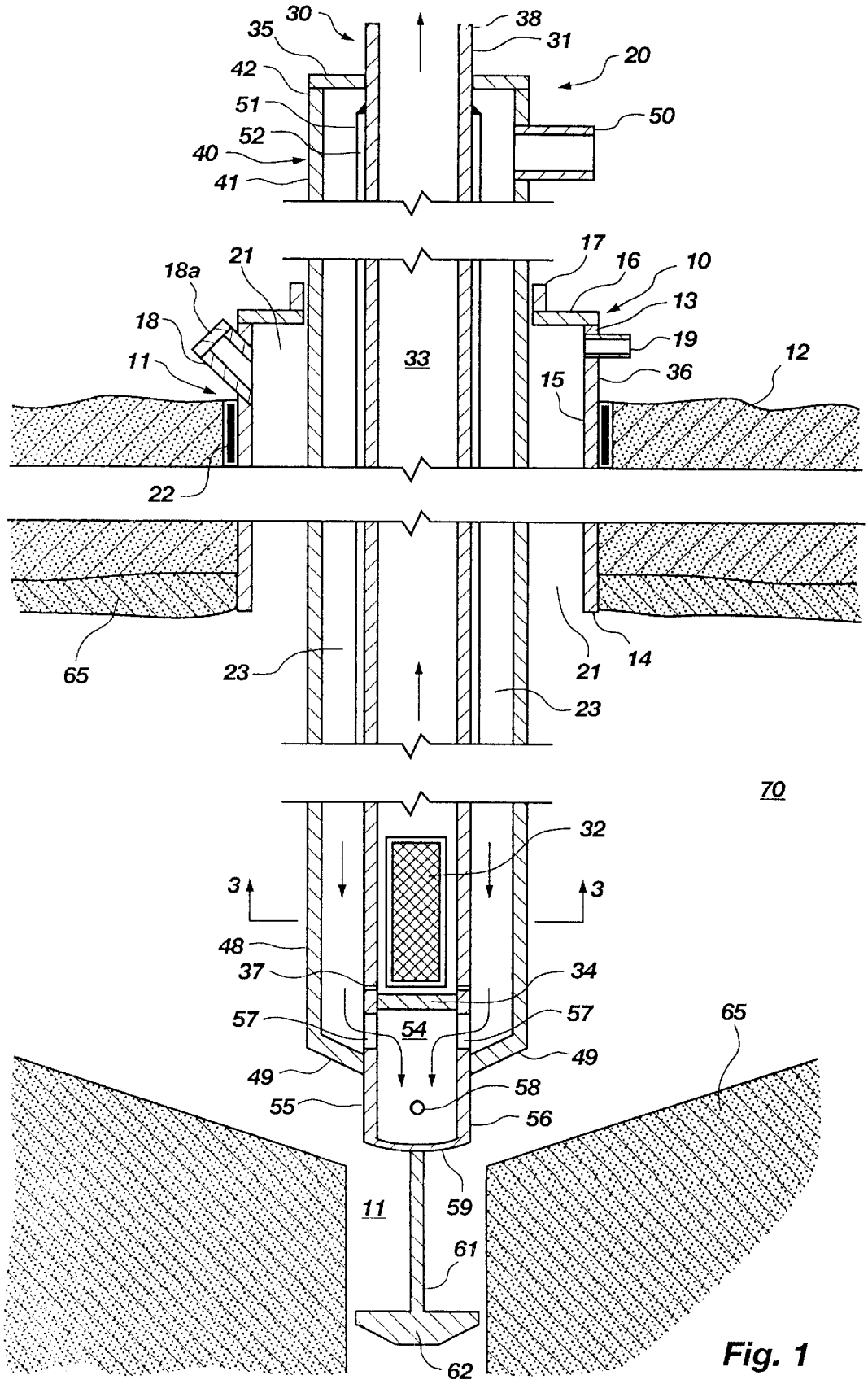
FIG. 1 is a segmented schematic sectional side view of the mining apparatus of the invention as it extends into a tar sand formation.

For the purposes of promoting an understanding of the invention, reference will now be made to the embodiments illustrated in the drawings and specific language will be used to describe the same. It will nevertheless be understood that no limitation of the scope of the invention is thereby intended. Any alterations and further modifications of the illustrated device, and any additional applications of the principles of the invention as illustrated herein, which would normally occur to one skilled in the relevant art and in possession of this disclosure, are to be considered within the scope of the invention claimed.

As used herein the term "aggregate" means crushed rock or other similar material having a particle size diameter of between about 0.5 and 1.5 inches and having rough or jagged edges or surfaces. Preferably the aggregate will be selected on the basis of hardness, jagged configuration and have a particle density of at least 130 lb/ft$^3$. Such aggregate serves as a scouring or grinding agent when in contact with a tar sand surface, particularly a surface that has been heated and softened by means of a hot water/diluent mixture.

Reference will now be made to the drawings in which the various elements of the present invention will be given numerical designations and in which the invention will be discussed so as to enable one skilled in the art to make and use the invention.

Figure 2:
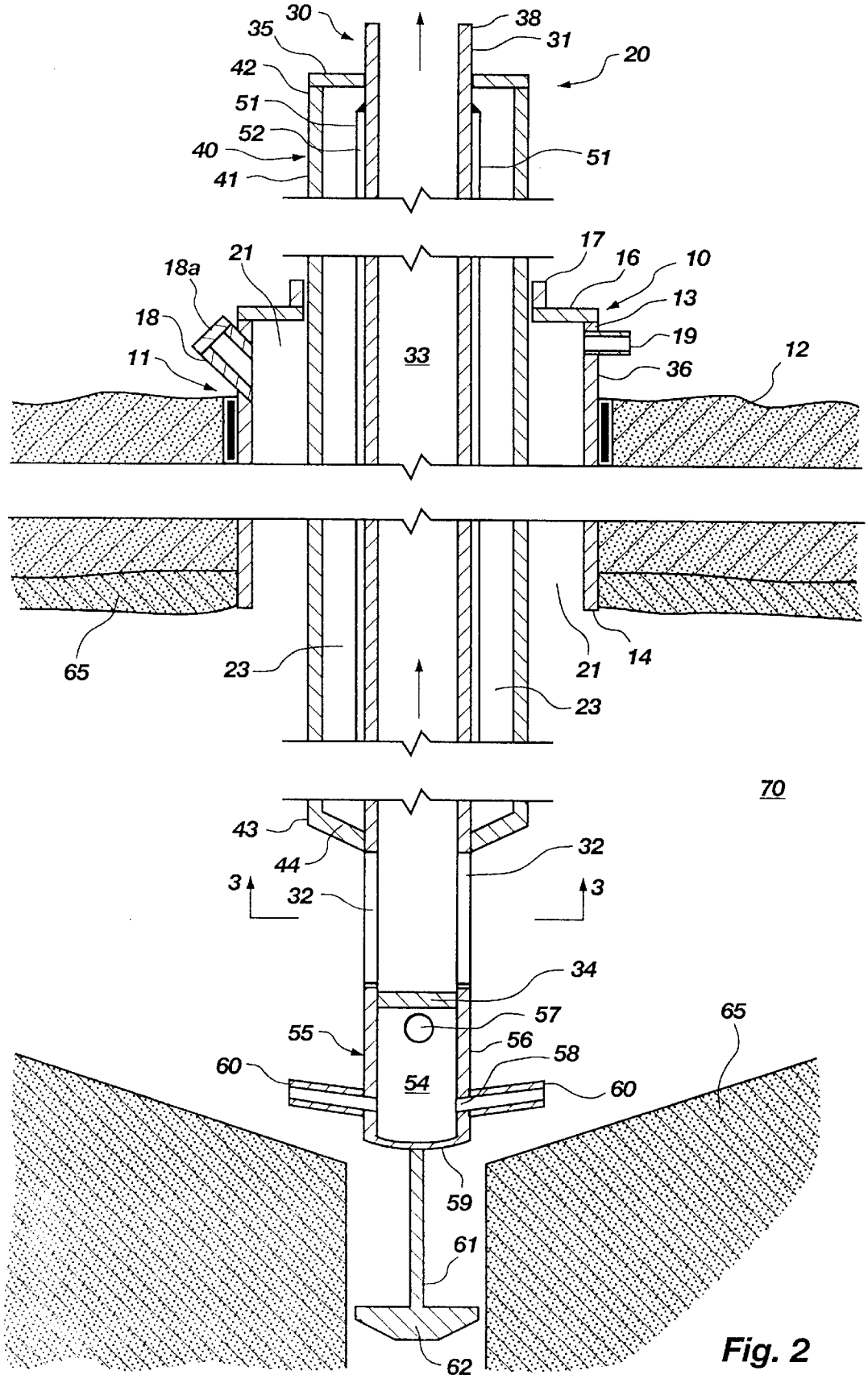
FIG. 2 is a segmented schematic sectional side view of the mining apparatus at right angles to the view shown in FIG. 1.
Figure 3:
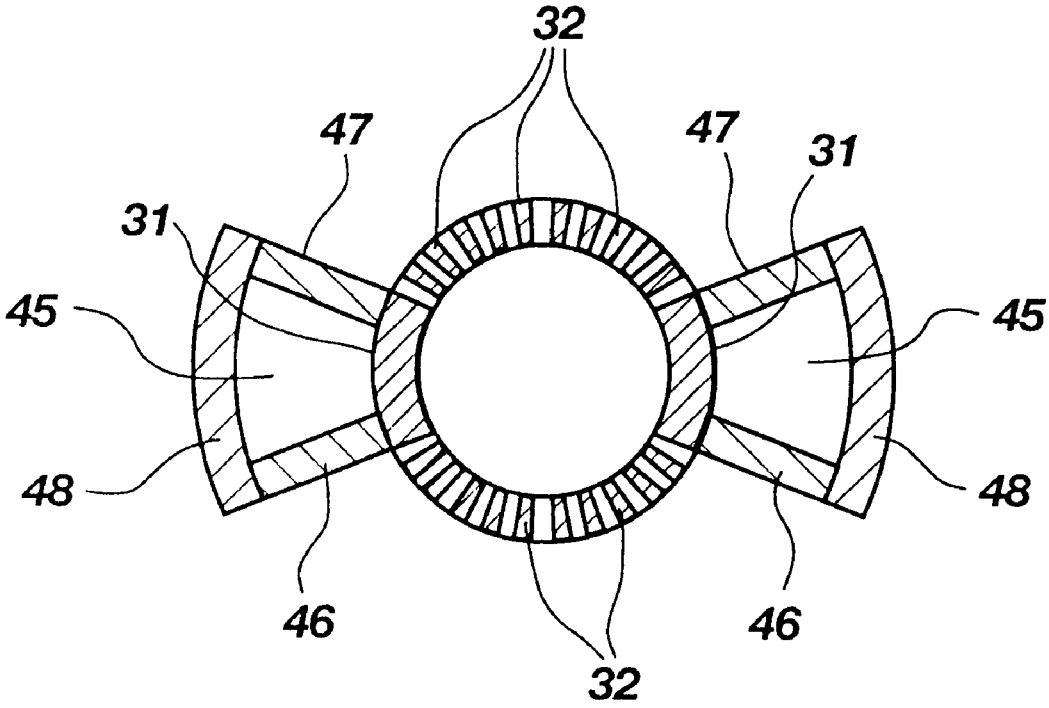
FIG. 3 is a cross-sectional view of the mining apparatus taken along section lines A—A of FIGS. 1 and 2.

The preferred embodiment of the apparatus for the mining operation is described in reference to FIGS. 1–3.

As shown in FIGS. 1 and 2, the apparatus for the mining operation comprises two fundamental components, a casing 10 and a mining tool 20. The casing 10 is adapted to be positioned into the mouth of a borehole 11 at the surface of overburden 12 and be cemented or otherwise sealed therein. The casing is hollow and has a proximate end 13 and a distal end 14. The casing wall 15 is adapted to provide lateral support at the upper end of the borehole and the length of the casing is sufficient that the proximal end extends above the overburden surface and the distal end extends into the upper portion of the tar sand deposit. Attached to the proximal end of the casing is an annular cap 16 which serves as a platform for the mining tool 20. An aperture in the center of the cap 16 provides an opening through which the mining tool 20 is inserted into the hollow of the casing so as to be rotatable therein but in such close tolerance as to substantially seal tar sand deposit being mined from the outside atmosphere. The cap 16 is shown having a circular flange 17 extending upwardly from the inner annular surface around the aperture to further support and guide the mining tool when inserted into the casing and to improve the sealing relationship. Additionally, near the proximal end of the casing, entry and exit conduits 18 and 19 respectively are positioned in the casing wall. Entry conduit 18 provide means for inserting aggregate into the tar sand deposit cavity as will be described below and is preferably sealed with a cap 18*a* when not in use so as to maintain pressure within the cavity. Exit conduit 19 provides a channel for conveying extracted bitumen and diluent from the cavity for further processing. As noted in FIGS. 1 and 2, there is an annular space 21 between the casing wall 15 and the mining tool 20 which provides a passageway for communication with the tar sand deposit and the resulting cavity that develops during the mining process.

The mining tool 20 comprises two major concentric tubular components, one nested inside the other. A slurry tube 30, comprising a generally cylindrical wall 31, is surrounded by a water entry tube 40 the upper portion of which also comprises a generally cylindrical wall 41 extending from its proximal end 42 to a distal position 43 which just proximal of the slurry intake 32 in the distal portion of the slurry tube. The space enclosed by the slurry tube 31 defines a slurry exit channel 33. The annular space 23 between the slurry tube 30 and the outer water tube 40 defines a hot water entry channel. Relative to the vertical plane of the mining tool, the water entry tube is reconfigured at the distal end portion by a partial floor 44 joining walls 31 and 41 such that the annular space 23 evolves to form two opposing water feed channels 45 bounded by opposing walls 46 and 47, an outer arcuate wall 48, which is contiguous with and is in the same vertical plane as wall 41, and the outer surface of the slurry tube wall 31, as shown in FIG. 3, and a slanting distal floor 49 as shown in FIG. 1. As best shown in FIG. 3, this reconfiguration near the distal end of the water tube exposes the slurry tube surface on opposing sides at right angles to the water feed channels 45. The exposed surfaces of the slurry tube contain open slurry intake grates 32 to allow entry of a sand and water slurry into the slurry tube while preventing entry of larger particles such as small rocks and aggregate as will be explained. Just beyond the slurry intake grates 32 is the distal end of the slurry tube which is sealed by a floor 34. In the slurry wall 31, just above floor 34 are small apertures 37 which allow communication between water channel 23 and slurry channel 33 and permit the entry of pressurized water from channel 23 into channel 33 below the slurry intake grates 32 to provide a highly turbulent zone at the bottom of the slurry tube and prevent an accumulation of solids that would block the intake grates. The grates are formed with openings that may be defined by parallel bars or intersecting grids or wires so as to provide openings of between about 0.25 to 0.5 inches, depending on the make up of tar sand formation being mined and the size of aggregate introduced into the mining operation via inlet 18 as will be described below.

An annular cap 35 is attached to the proximal end of the water tube 40 having an aperture through which the slurry tube protrudes upwardly to its proximal end 36. Cap 35 seals and defines the upper end of annular space 23. Just below the cap 35 in the wall 41 of water inlet tube 40 is located a hot water inlet connection 50 as shown in FIG. 1. Surrounding the outer wall of slurry tube 30 from a position just distal of cap 35 and extending to a position just proximal of where the annular water channel evolves to opposing water feed channels 45 is a thin walled tube 51 defining a narrow channel 52 that is adapted to hold water or any other suitable fluid or insulation means to serve as a barrier to minimize heat transfer between hot water flowing downward in the annular hot water channel 23 and the cooler temperature of a sand and water slurry flowing upward in the slurry channel 33.

A hot water manifold 55 extends distally from the floor 34 of the slurry tube and is defined by a tubular manifold wall 56 which is essentially a continuation of the slurry tube wall and terminates in a manifold floor 59. The slanting distal floor 49 and opposing sides 47 and 48 of the water feed channels joins and seals the channels to the manifold wall 56. Entry apertures 57 located in the manifold wall just above the juncture of the slanting water feed channel floor with the manifold wall permit water entry from the water feed channels 45 into the manifold interior 54. Near the lower or distal portion of the manifold wall, and at right angles to the entry apertures are apertures 58 which are in fluid communication with jet nozzles 60 which are attached to the outer manifold wall surface and extend outwardly and upwardly at a predetermined angle so as to discharge jets or streams of high pressure hot water into the tar sand deposit when the tool is in use.

Extending vertically or downwardly from the manifold floor 59 is a shaft 61 to which is attached a drill hole plug 62.

The above description essentially describes the mining tool to which modifications or defining parameters may be determined by those skilled in the art. Specific dimensions, aperture sizes, diameter of casing, water and slurry tubings and the like may be readily determined according to the size of the operation to be carried out. Casings, water injection tubes, slurry tubes and the like are known in the art. Typically, a casing will be from about 10 to 18" in diameter and will be of a length sufficient to pass through the overburden into the tar sand deposit. The length of the casing may therefore range from about 10 to 500 feet or even beyond. Since the mining tool fits inside the casing the water and slurry tubes will be sized accordingly. Further, the depth at which a mining tool penetrates through the casing into the tar sand deposit will vary greatly but will be considerably longer than the casing. Therefore, except for the proximal and distal ends of the water and slurry tubes, the tool as described may be provided in sections which may be joined together by appropriate interconnecting means such as threaded engagement, slip fit joints, tongue and groove joints and the like.

The tool will also contain means for causing at least 180° rotation back and forth around its vertical axis. This may be accomplished by conventional means, such as a cable wound around the upper portion of the tool the ends of which can be pulled in opposite directions by appropriate means.

Figure 7:
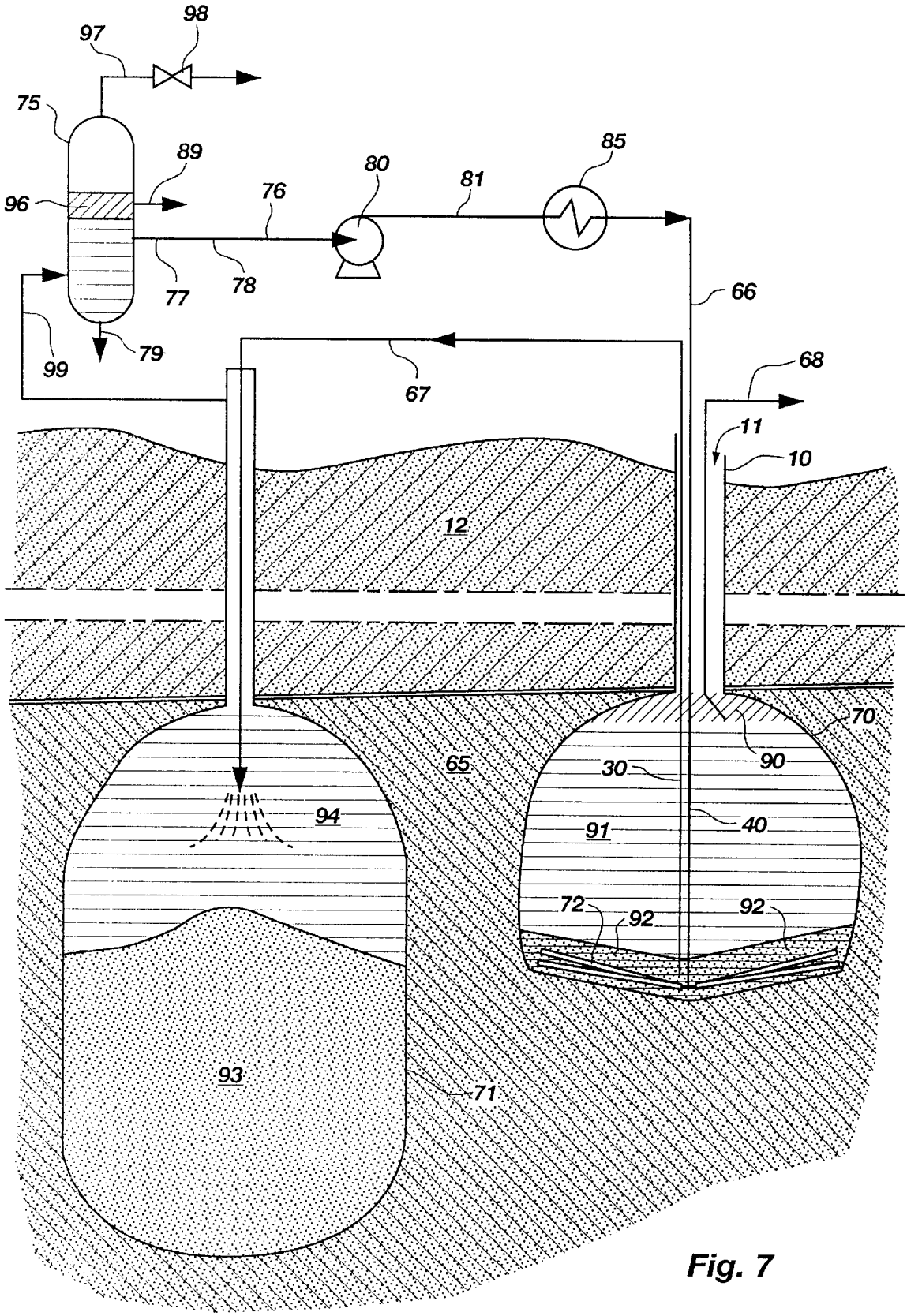
FIG. 7 is a flow diagram of the hydraulic mining process of the present invention showing essential components of the processing system.
Figure 8:
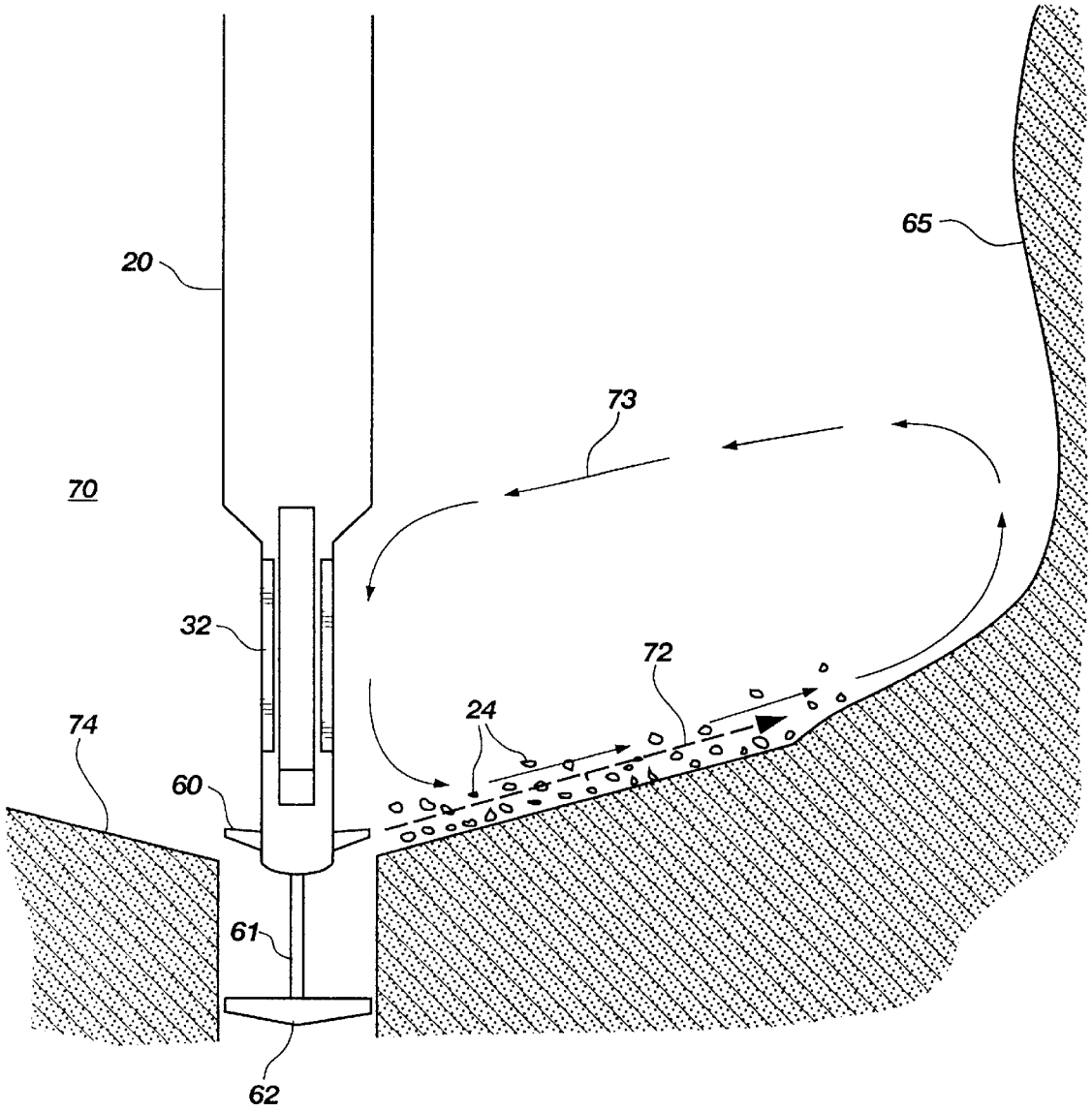
FIG. 8 is a schematic side view of the aggregate circulation path to facilitate the tar sand erosion and bitumen separation process when the mining apparatus is in operation.

In other words, the mining tool 20 when inserted into casing 10, secured in a borehole is rotatable so as to enable the nozzles 60 to rotate in a tar sand deposit at least 180° in the presence of added broken or jagged aggregate to more efficiently erode the tar sands and the resulting sand slurry to be collected and removed through the grates 32 into the slurry channel 33 while the separated bitumen rises to the to the top of water in the mined cavity for collection as will be explained in connection with FIGS. 7 and 8.

Appropriate tubing and connections are attached to the hot is water inlet 50, the proximal end of slurry tube 30 and the bitumen outlet 19 as will be explained in connection with the mining operation.

Using the mining apparatus as defined in FIGS. 1–3, the hyraulic mining process will now be described and reference to FIGS. 1–3, 7 and 8 will be made as appropriate.

FIG. 7 is a flow diagram schematically demonstrating the overall hydraulic mining process of the current invention. In addition to the mining apparatus, as described above, the mining process requires the presence of means to provide hot water under pressure, water recirculation, slurry disposal, bitumen recovery and the like. These will be discussed in due course and are schematically illustrated in FIG. 7.

Typically the topography of a site to be mined will comprise a tar sand deposit 65 underlying a surface overburden 12. Initially, a borehole 11 is drilled through the overburden 12 and into the tar sand deposit 65. This borehole is of sufficient diameter to accommodate the casing 10. Preferably, drilling is continued through the tar sand deposit 65 and beyond with a borehole that is of sufficient diameter to accommodate a drill hole plug 62 located at the end of the mining apparatus as described above.

Into the borehole the casing 10 is positioned in the upper end of the borehole 11 and is cemented into place to form a seal 22 to inhibit escape of fluids during the mining operation. The casing 10 provides lateral support to the overburden 12 material and also provides a platform to which the remaining components of the mining apparatus are attached. The sealing of the casing 10 into the borehole 11 is important to permit the pressurization of the hydraulic mining and removal of the bitumen and sand slurry. Maintaining a proper pressure gradient in the developing cavity as the mining progresses is important not only to maintain the integrity of the cavity by preventing a collapse of the overburden to the extent practical but also to cause the bitumen and sand slurry material to flow out of the cavity.

As shown in FIGS. 1 and 2, the proximal portion of the casing 36 extends above the overburden 12. By designing the casing 10 to extend above the overburden 12, it is possible to have access to the cavity formed by the mining process to add aggregate through entry conduit 18 and remove bitumen or a bitumen/diluent combination from exit conduit 19. It is also more convenient to insert the mining tool 20 through the annular casing cap 16 and lower and rotate the mining tool as the mining progresses deeper into the tar sand deposit 65.

With the casing firmly in place in the borehole, the mining tool is inserted through the aperture in the annular casing cap 16 and lowered into position in the borehole 11 until the drill hole plug 62 penetrates the tar sand deposit a sufficient distance that the hot water nozzles 60 of the hot water manifold 55 are in the tar sand deposit 65. Cap **18*a* is removed from the entry conduit 18 and the annular space 21 between the casing and the mining tool is charged with crushed aggregate. Such aggregate will be of any suitable configuration but will preferably have a jagged surface so as to function as an eroding or abrading means and will have a minimum diameter larger than the intake spaces in the slurry grate and a maximum diameter such that the aggregate particle will circulate in the developing mined cavity 70 under pressure of hot water ejected as a jet from the nozzles 60** in the mining tool.

Typically suitable aggregate dimensions may be between about 0.5 and 1.5 inches. Additional or makeup aggregate can be added to optimize the mining operation.

The exit conduit 19 in the casing is connected via line 68 to fractionation means (not shown) for processing of the bitumen and diluent recovered from the mining operation. A hot water feed line 66 connects hot water inlet 50 of the water tube 40 with the water recirculation system as will be described. Further, the proximal end 38 of the slurry tube is connected via line 67 to a slurry disposal and water recovery source, which is preferably a previously mined out tar sand cavity 71.

The mining tool 20 is supported above grade, i.e. above the overburden, in such a manner that it can be mechanically rotated and also lowered into borehole 11 in the tar sand deposit as the mining progresses. Rotation and lowering of the mining tool 20 is necessary in order for jets of hot water/diluent from nozzles 60 to cover the entire floor area 74 of the developing cavity 70 as it is being formed and enlarged. The rotation and lowering of the tool are preferably automated and the rate of movement automatically controlled to optimize mining conditions and cavity or pit geometry.

With the above grade piping in place, the mining operation is ready for operation.

The mining tool 20 is lowered into position in casing 10 to the point that the drill hole plug 62 penetrates into the borehole 11 sufficiently that the nozzles 60 are below the overburden 12 and is surrounded by tar sand 65. Aggregate 24 is then added surrounding nozzles 60 and falling into borehole 11 along shaft 61 above drill hole plug 62.

Hot high pressure recirculating water and diluent from surge tank 75 passes from the surge tank along line 76, where it may be supplemented by make up water from line 77 and added diluent through line 78 into pump 80. The action of the pump results in a pressure increase and the water then passes through line 81 on to water reheat exchanger 85 where the temperature is raised for passage through line 66 into hot water connection 50 into hot water channel 23 of water tube 40. The hot water diluent mixture passes through channel 23 and channels 45 through apertures 57 and into the interior 54 of manifold 50. From the manifold 50 jets of hot water and diluent are forced through apertures 58 out through nozzles 60. Preferably nozzles eject a high pressure water jet at an angle that, relative to the vertical axis of the mining tool, is not quite at right angles or horizontal. In other words, the hot water jets are at an outward trajectory that is just a few degrees upward from a horizontal plane. While the angle of the jets may vary from about 1–20° upward from horizontal, the exact angle is best empirically determined by the makeup of each tar sand deposit and any functional angle may be utilized. Having the jets projecting outwardly from nozzles 60 at a slight upward angle provides a more efficient scouring or grinding action with the aggregate 24 thereby loosening of the tar sand from the deposit into the minded cavity 70 as the tool is lowered into the deposit 65.

The hot water/diluent jet passes from the nozzles 60 at a pressure sufficient to dislodge and erode the tar sand from the floor 74 and walls of the cavity 70. Typically the pressure of the water/diluent jet will be between about 100 and 1000 psi, however any pressure that is functional may be used. The water jet impacts both the tar sand deposit 65 and the aggregate 24, that has not filled the void in the borehole above the drill hole plug 62, causing a scouring action. The hot water jet moves outwardly as shown by the dark lined vector 72 in FIG. 8 and, the force of the hot water dissipates as it moves outwardly from the jets. The water energy is used or absorbed by the action of the aggregate moving at high velocity across the floor 74 of the cavity 70. Heat from the water heats the upper layer of the tar sand deposit on the floor 74 of the cavity being mined causing the layer to soften. The aggregate 24 follows a path as shown in FIG. 8 by the lighter lined arrows 73. This path is initially the same as the hot water jet but tends to circulate as shown by the arrows in FIG. 8 back toward nozzles 60. The water jets 72 impact both the tar sand deposit surface and the crushed aggregate.

The mining tool is rotated such that nozzles 60 are caused to rotate slowly over no less than 180° in alternate directions on a controlled cycle to cover the entire floor 74 of cavity or pit being mined. The mining tool 20 is caused to move downwardly into the tar sand deposit to advance the mining process and cause the water jets and aggregate to constantly scour or scrape the tar sand from the deposit into the cavity. Additional aggregate may be added, as warranted, as the mining process continues.

As indicated in FIG. 8, the hot water jets from nozzles 60 impact aggregate 24 at the floor 74 of the cavity, creating a turbulence that scours or grinds a layer of softened tar sand away from the floor 74 of the cavity 70. The periodic removal of softened tar sand facilitates rapid heating and softening of the next layer to be removed. The vertical walls of the cavity formed are exposed to water at temperatures nearly as high as the water emanating as a jet from the nozzles 60 but does not penetrate the walls rapidly since removal of tar sand occurs only after the softened layer is sufficiently thick to break away and fall into the aggregate grinding zone in the cavity 70. The balance between the rate of removal of tar sand at the floor 74 of the cavity compared with the removal at the walls determines the cavity geometry. If all operating variables are held constant when mining a tar sand deposit, the geometry of mined out cavities will tend to be very similar, thus permitting a high percentage recovery of bitumen from any particular formation.

As the cavity 70 forms it is filled with hot water into which the dislodged tar sand disintegrates. The bitumen contained in the disintegrated tar sand is released from the sand particles. The separation of the bitumen from the sand is facilitated by the hot water and the diluent in the water which combines with the bitumen thereby lowering its density and viscosity. The bitumen combined with the diluent forms a separate phase 90, which is lighter than the water phase 91, and rises to the top of the cavity 70 from which it is transferred, by appropriate means not shown, through outlet 50 in casing 10 and through line 68 for centrifuging and fractionation or other processing. The bitumen/diluent phase is removed at a rate that is consistent with phase formation.

The rate of liquid removal from the cavity, either bitumen phase or water and sand slurry, is such that the cavity remains filled with a combination of bitumen/diluent phase and/or water phase during the mining process to protect the integrity of the cavity.

The treatment of the bitumen, once removed through the casing, via line 68 is conventional and does not necessarily form part of the invention. However, it might be noted that the diluent, which is preferably the low boiling fraction of the bitumen having a gravity of 30 or higher, may be recovered during the fractionation process and recycled to the mining operation via line 78. Also, excess or recovered diluent may be used as fuel to heat the recycled water/diluent in heat exchanger 85 or may be sold or transported for other uses or processing. The heavy bitumen recovered from fractionation may be processed according to conventional means to produce the desired end products.

The pressure differentials within the hot water circuit are such that, when the bitumen is released from the sand in cavity 70, a sand slurry 92 is formed in the lower area of the cavity 70. The slurry 92 passes through intake grates 32 into slurry channel 33 of tube 30 and is conveyed upward out of the mining tool for disposal.

A small amount of the hot water in channel 23 is diverted through apertures or slots in wall 31 of the slurry tube into the distal area of the slurry tube above floor 34 and passes upwardly through channel 33 to help maintain a uniform sand slurry mixture.

The hot water injected into channel 23 and out through nozzles 60 functions to dislodge the tar sand particles from deposit 65 and also serves as a water phase 91 supporting the separated bitumen phase 90. The water also combines with the sand to form a slurry 92. It is apparent that heat will be lost during the mining of the tar sand and that the slurry 92 exiting the system via channel 33 will have a lower temperature than that of the water/diluent injected through channel 23. To minimize heat loss to the hot water entering through channel 23 by means of heat exchange with the slurry 92 exiting channel 33, the system contains a thin walled tube 51 forming an annulus 52 filled with water or other insulating medium as previously described.

Using state of the art flexible hose fittings, a slurry line connection is made at the proximal end 38 of slurry tube 30 to above grade piping 67 to accommodate movement of the mining tool 20.

The water in the slurry 92 will contain significant amounts of bitumen/diluent mixture that remains entrained in the water phase 91 as not all bitumen/diluent will rise to the surface of the cavity for removal out of casing 10 via line 68.

The water in the slurry exiting slurry channel 33 is at a temperature that is about 40 to 75° F. cooler than the hot water fed into channel 23. Initially, the slurry is charged directly to the pump surge tank 75 and sand is withdrawn through line 79 and sent to an above grade settling pond.

Once a mined out cavity is available the slurry separation process is carried out by means of piping the slurry via line 67 to a mined out cavity 71 via line as shown in FIG. 7. The sand 93 settles to the bottom of the cavity and the hot water/bitumen/diluent mixture 94 is returned to the surface through piping 95 above grade.

With reference to FIG. 7. the sand depleted water 94 passes via line 95 to a pump surge tank 75 which includes level controls to water phase 95 and bitumen/diluent phase 96 levels in the surge tank. Pressure in the surge tank 75 is controlled by introducing a hydrocarbon gas, such as natural gas or propane, into the tank via line 97 with pressure determined by means of a pressure control valve 98. This feature makes it possible to operate at the hot water temperature best suited to a particular sand formation including temperatures well above the normal boiling point of water. Further, it permits operating the system at pressures in the mining and sand disposal cavities high enough to help maintain the structural integrity of the these cavities.

The combined bitumen/diluent phase 96, being lighter than the hot water phase 95 can be drawn off via line 89 for centrifuging and fractionation. Water 94 drawn from the sand disposal cavity 71 contains a significant amount of fines. A portion of the water entering the surge tank is withdrawn via line 79 for disposal, such as in a fines settling pond. This provides a means for controlling the amount of fines recirculated in the hot water loop.

The water 95 in surge tank 75 is withdrawn at a point near the top of the water phase for recycling. This water exits tank 75 by means of line 76 which is also in fluid communication with line 77 containing make-up water and line 78 containing diluent.

The water in line 76 is suctioned from the pump surge tank by means of water circulation pump 80 for subsequent reheating and reintroduction into channel 23 of the mining tool 20. As noted above, make-up water and diluent are added just upstream of pump 80. The discharge pressure of the pump is optimized for a given tar sand deposit on the basis of field tests recognizing that in addition to circulating hot water the pump provides the energy for the scouring and grinding action of the water jets and aggregate in the cavity being mined. Pump outlet pressures can be expected to be in the general range of 100 to 1000 psig.

The water circulation loop is completed by passing the recirculating water from pump 80 along line 81 which passes through a water reheat exchanger 85. Various sources of heat may be used such as steam, a fired heater or waste heat from another process. The optimum temperature of water leaving the reheat exchanger 85 through line 66 is determined empirically but will generally be in the range of between about 150 to 300° F.

Figure 4:
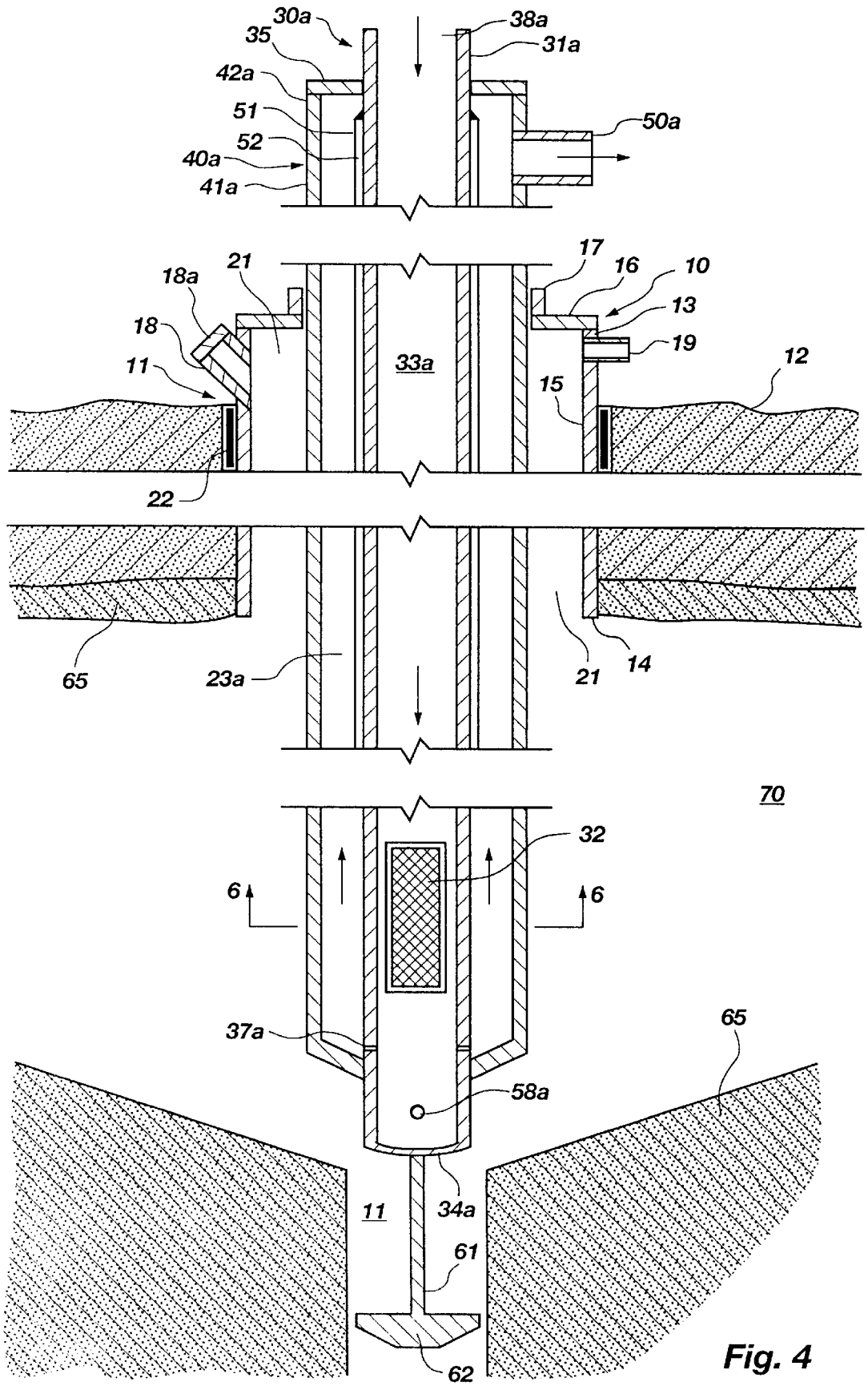
FIG. 4 is a segmented schematic sectional side view of a second embodiment of a mining apparatus having the slurry exit and water inlet channels reversed from the position shown in FIG. 1.
Figure 5:
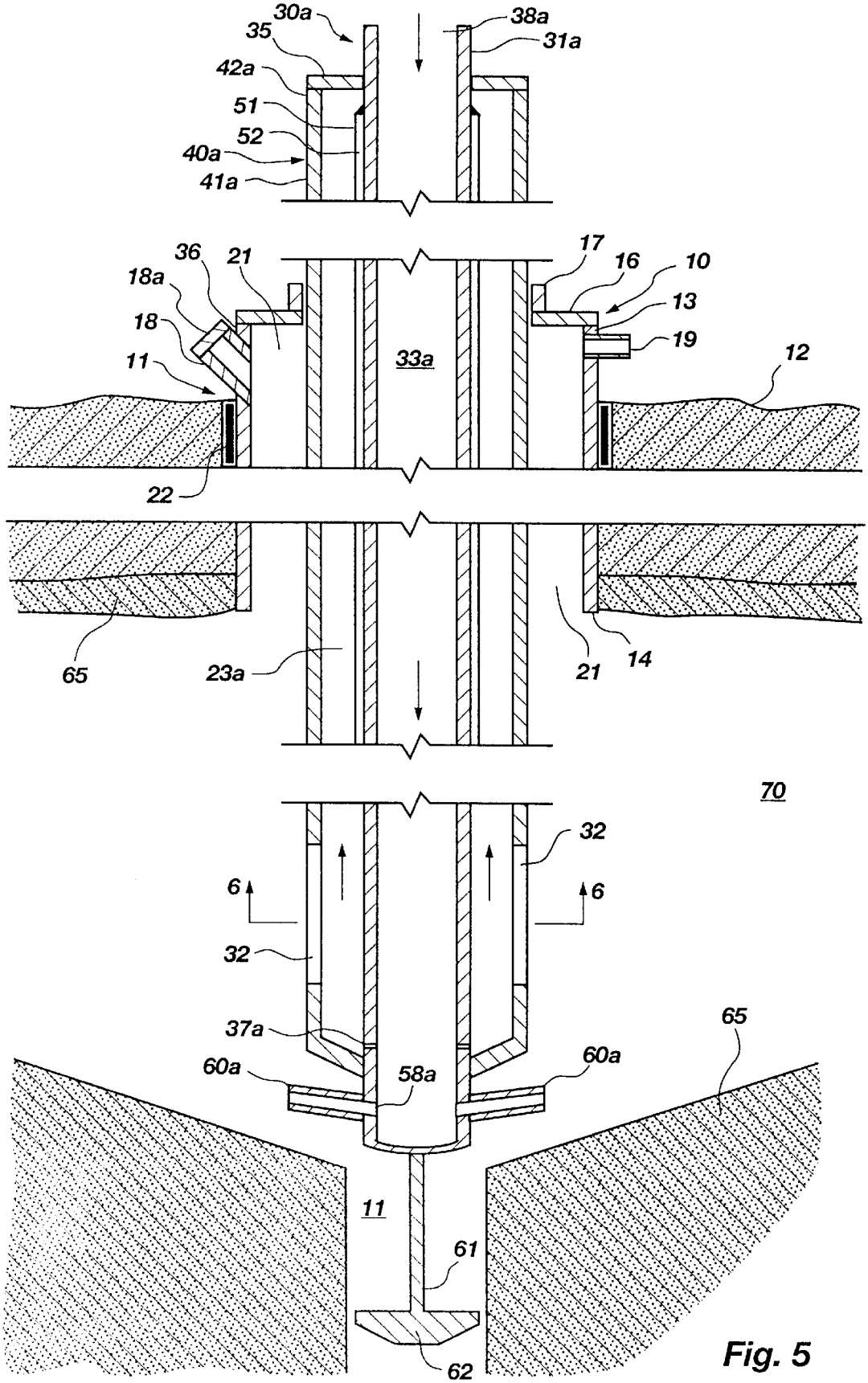
FIG. 5 is a segmented schematic sectional side view of the mining apparatus at right angles to the view shown in FIG. 4.
Figure 6:
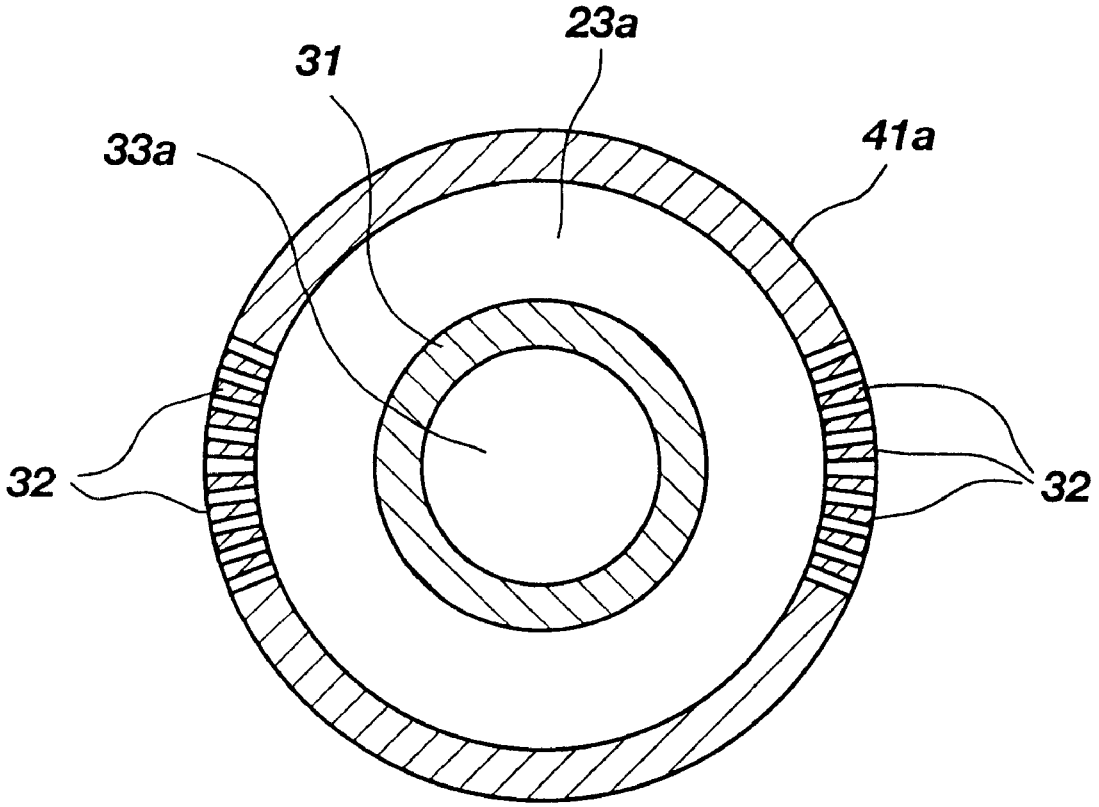
FIG. 6 is a cross-sectional view of the mining apparatus taken along lines section B—B of FIGS. 4 and 5.

FIGS. 4–6 show a second embodiment of a mining tool 20*a* that is similar to that disclosed in FIGS. 1–3 differing primarily in that the direction of flow of the hot water entering the mining tool and the slurry exiting the tool are reversed.

As shown in FIGS. 4 and 5, the apparatus for the mining operation comprises two fundamental components. In all respects casing 10 is the same as described in FIGS. 1 and 2 and will not be further described except as necessary to explain the functioning of mining tool 20*a*.

The mining tool 20*a* comprises two major concentric tubular components, one nested inside the other. A water inlet tube 30*a*, comprising a generally cylindrical wall 31*a*, is surrounded by a slurry exit tube 40*a* which also comprises a generally cylindrical wall 41*a* extending from its proximal end 42*a* to a distal floor 34*a* which just proximal of the nozzles 60 in the distal portion of the water inlet tube 30*a*. The space enclosed by the water inlet tube 31*a* defines a hot water inlet channel 33*a*. The annular space 23*a* between the inlet tube 30*a* and the outer slurry tube 40*a* defines a slurry exit channel 23*a*. The slurry tube wall 41*a* contains open slurry intake grates 32 just above distal floor 34*a* to allow entry of a sand and water slurry into the slurry tube while preventing entry of larger particles such as small rocks and aggregate. In the inlet tube wall 31*a*, just above floor 34*a* are small apertures 37 which allow communication between water channel 33*s* and slurry channel 23*a* and permit the entry of pressurized water from channel 33*s* into channel 23*a* below the slurry intake grates 32 to provide a highly turbulent zone at the bottom of the slurry tube 40*s* and prevent an accumulation of solids that would block the intake grates.

An annular cap 35 is attached to the proximal end of the water tube 40*a* having an aperture through which the water inlet tube protrudes upwardly to its proximal end. Cap 35 seals and defines the upper end of annular space 23*a*. Just below the cap 35 in the wall 41*a* of slurry exit tube 40*a* is located a slurry outlet connection 50*a* as shown in FIG. 4. Surrounding the outer wall of water inlet tube 30*a* from a position just distal of cap 35 and extending to a position just proximal of where the annular water channel evolves to opposing water feed channels 45 is a thin walled tube 51 defining a narrow channel 52 that is adapted to hold water or any other suitable fluid or insulation means to serve as a barrier to minimize heat transfer between hot water flowing downward in the hot water channel 33*a* and the cooler temperature of a sand and water slurry flowing upward in the annular slurry channel 33*a*. *Near the lower or distal portion water inlet tube 33a* are apertures 58*a* which are in fluid communication with nozzles 60 which are attached to the inlet tube wall 31*a* and extend outwardly and upwardly at a predetermined angle so as to discharge jets of high pressure hot water into the tar sand deposit when the tool is in use.

Extending vertically or downwardly from the inlet tube floor 34*a* is a shaft 61 to which is attached a drill hole plug 62.

In this embodiment, the tool functions as described with reference to FIGS. 1–3, 7 and 8 except that the flow of fluids through the tool is reversed. In some ways, tool 20*a* is somewhat simplified over tool 20 in that there is a direct flow of hot water through inlet tube 30*a* to nozzles 60 rather than having the hot water channeled to a manifold.

With reference to the apparatus and system described in relation to FIGS. 1–3, 7 and 8 there follows an example of a typical mode of operation.

EXAMPLE

The following description is representative of the process of the present invention in the hydraulic mining of tar sand and recovery of bitumen from a single cavity.

A borehole 11 is drilled through the overburden 12 and extends into a tar sand deposit 65 in the manner described above. Into the borehole 11 is inserted a casing 10 which is cemented in place by a seal 22. A mining tool 20, as described above, is then passed through the casing and into the tar sand deposit with the drill hole plug 62 positioned in the borehole 11 below the mining tool 20 as described.

The deposit is a tar sand having an ambient temperature of about 50° F. comprising about 11.7% by weight bitumen in a sand base having a screen size distribution as follows:

| Screen Size | Weight Percent |
|---|---|
| No. 16 × No. 50 | 6.2 |
| No. 50 × No. 100 | 74.6 |
| No. 100 × No. 200 | 13.0 |
| No. 200 minus | 6.2 |

The process, as described, is based on the mining of 77,000 lbs/hr of a tar sand comprising 9,000 lb/s hour bitumen (specific gravity ~1 gm/cm$^3$) and 68,000 lbs/hr of sand as described.

The process is started by charging the borehole 11 through annular casing space 21 with 2 to 5 tons of ¾" to 1½" crushed rock as aggregate 24 and mining is initiated by pumping water into channel 23 via line 66. Additional aggregate will be required as mining continues.

As start-up proceeds operation will stabilize with the water/diluent mixture in channel 23 at a pressure of about 300 psig and a temperature of 240° F. The water/diluent mixture is injected at the rate of 125,000 lbs/hr water and 3,600 lbs/hr diluent. Typically, the water/diluent charged through line 66 will be primarily recirculating water from surge pump tank 75 along with makeup water from line 77 and diluent from line 78 and will contain about 6,000 lbs/hr fine sand of which 95% weight is screen size No. 200 minus and about 5% weight is screen size No. 100×No. 200.

The hot water/diluent injected through channel 23 passes through manifold 55 and out through nozzles 60 at approximately the aforementioned temperature and pressure. The mining tool 20 is rotated through at least 180° cycle and lowered as needed to scour tar sand from the floor 74 of the cavity being mined. The force of the hot water/diluent, the action of the aggregate, the softening of the bitumen, all of which have previously been described, results in about 10,600 lbs/hr of a bitumen/diluent mixture and 315 lbs/hr fine sand rising to the surface of the water phase 91 in the cavity being mined and being withdrawn from line 68 at a pressure of about 40 psig and at a temperature of about 150° F. for passage to a centrifuge and then to fractionation.

The sand separated from the bitumen in the cavity settles toward the bottom and is withdrawn as a sand/water slurry 92containing about 16 percent of the bitumen/diluent mixture produced through intake grates 32 into slurry channel 33 at a pressure of about 40 psig and a temperature of about 200° F. The slurry 92 comprising about 120,000 lbs/hr water, 2,000 lbs/hr of bitumen/diluent and 73,683 lbs/hr sand (sand distribution 5.76 screen size 16×50; 68.9% screen size 50×100; 12.4% screen size 100×200 and 13.0% screen size 200 minus) is passed via line 67 to a disposal pit 71 which is preferably a previously mined out cavity where the sand 93 falls by gravity to the bottom of the cavity 71 thereby separating from the liquid phase 94. The liquid phase 94 is withdrawn from the sand disposal pit 71 via line 99 at a pressure of about 35 psig and temperature of about 195° F. and enters the pump surge tank 75 at the rate of about 115,000 lbs/hr water; 1,500 lbs/hr bitumen/diluent and 6,550 lbs/hr of entrained sand fines. The liquid entering the pump surge tank separates into an oil phase (bitumen/diluent) 96 and a water phase 95. Pressure in the tank is controlled by means of a gas blanket. Pressure in the tank may be increased or decreased as needed by a hydrocarbon or inert gas passed through line 97 and control valve 98. Water and suspended sand fines are withdrawn from the bottom of pump surge tank at the rate of 10,000 lbs/hr water and 500 lbs/hr fine sand and transferred to a settling pond in order to control fines build-up in the recirculating water circuit. Bitumen/diluent mixture at the rate of 1,500 lbs/hr bitumen/diluent and 50 lbs/hr fine sand is withdrawn via line 89 and combined with product from line 68 for subsequent centrifuge and fractionation.

Water is withdrawn from a central portion of the pump surge tank, below the bitumen/diluent phase 96, via line 76 at the rate of 105,000 lbs/hr containing 6,000 lbs/hr fine sand at a pressure of 30 psig and temperature of 190° F. Into line 76 is introduced 20,000 lbs/hr makeup water through line 77 and 3,600 lbs/hr diluent through line 78. The recirculating water, makeup water and diluent are then passed through water recirculation pump 80 through which an increase in pressure takes place and then on to water reheat exchanger 85 where the temperature of the water/diluent is raised to 240° F. at a pressure of 300 psig for reintroduction back into line 66 and into the mining tool to continue the mining cycle.

While the invention has been described and illustrated with reference to certain preferred embodiments thereof, those skilled in the art will appreciate that various modifications, changes, omissions, and substitutions can be made without departing from the spirit of the invention. It is intended, therefore, that the invention be limited only by the scope of the following claims.

What is claimed is:

1. A method for the hydraulic removal of bitumen from a tar sand deposit located beneath surface overburden comprising:

a) forming a borehole through said overburden into the tar sand deposit;

b) affixing a casing into the borehole said casing having a proximal end above the grade of said surface overburden and extending downward through said overburden into said tar sand deposit and terminating at a distal end, said casing having a central opening at said proximal end through which a mining tool may be inserted and having aggregate entry means and bitumen/diluent removal means adjacent said proximal end above grade through which aggregate material may be added to the casing interior and from which bitumen/diluent may be removed from said casing;

c) inserting into said casing a mining tool comprising concentric inner and outer tubes, each having generally cylindrical walls and proximal and distal ends with the proximal ends extending above grade and above the proximal end of said casing, the interior of said inner tube forming a slurry outlet channel, the annular space between said inner and outer tubes forming an annular water/diluent inlet channel and the space between said outer tube and said casing further forming an annular mining cavity access channel, said mining tool further comprising walled ducts at the distal end of said outer tube and forming a continuation thereof and an interconnecting manifold extending distally from the distal end of said inner tube, i) said inner tube having connecting means at its proximal end above said casing for conveying a slurry out of said mining tool and having a distal floor separating said inner tube from said manifold said inner tube having intake grates in said cylindrical wall just above said distal floor for allowing entry of a slurry from a cavity being mined into said slurry outlet channel;

ii) said outer tube having connecting means at its proximal end above said casing for conveying a water/diluent mixture into said water/diluent inlet channel, said outer tube merging into walled ducts at its distal end portion so as to expose said intake grates of said inner tube, said walled ducts extending distally beyond the distal end of said inner tube and feeding into said manifold;

iii) said manifold being defined by said distal floor of said inner tube, a manifold floor and an interconnecting cylindrical wall, said cylindrical wall having inlet apertures in fluid communication with said walled ducts and having located adjacent said manifold floor outwardly extending high pressure nozzles for injecting jets of hot water/diluent passing from said water/diluent intake channel, through said walled ducts and into said manifold;

said mining tool extending through said casing and into said borehole such that said intake grates and high pressure nozzles are in said tar sand deposit;

d) adding aggregate through said aggregate entry means sufficient to cover said intake grates of said inner tube;

e) alternately rotating said mining tool horizontally over at least 180° rotation while injecting into said outer tube, under high temperature and pressure, a water/diluent mixture causing said water/diluent mixture to pass through said water/diluent inlet channel, walled ducts and manifold and out said nozzles under high pressure and temperature such that a cavity is formed in said tar sand deposit by the temperature of the hot water softening the tar sand deposit and the force of the water jets and impact of the aggregate scouring the tar sand to remove tar sand from a developing floor and walls of a water filled cavity being formed in the deposit such that the bitumen in the tar sand interacts with the diluent present in the hot water lowering the viscosity of the bitumen and separating it from the sand particles such that the bitumen/diluent rises to the surface of the water in the cavity thereby forming a bitumen/diluent upper phase and a water/sand slurry phase at the bottom of the water filled cavity, removing bitumen/diluent phase through said bitumen/diluent removal means in said casing, withdrawing through said intake grates a water/sand slurry phase along with residual bitumen/diluent remaining in said water/sand slurry phase into said slurry channel and which passes upwardly and out of said mining tool for processing or disposal;

f) lowering said mining tool in said casing and borehole as the mining progresses such that the water/diluent passing through jets scours the floor of the developing cavity in said tar sand deposit and adding such aggregate as is necessary to optimize the scouring action of the combination of aggregate and high pressure water/diluent jets.

2. A method according to claim 1 wherein attached to the manifold floor and extending downwardly from said manifold floor is a shaft to which is attached at its opposite end a drill hole plug, said plug having a diameter essentially the same as the borehole such that said shaft and plug extend into said borehole thereby preventing aggregate from filling said borehole and serving as a guide for said mining tool as it is progressively lowered in said borehole.

3. A method according to claim 2 wherein said mining tool is lowered at a rate such that said jets of water/diluent continuously impinge on the aggregate and the tar sand at the floor of the cavity being mined such that the tar sand at said floor is heated and removed from the floor surface by the combined grinding action of the impinged aggregate and jets of water/diluent.

4. A method according to claim 3 wherein the rate, pressure and temperature of the water/diluent jets passing through said nozzles into said cavity determine the rate at which the mining tool is lowered.

5. A method according to claim 4 wherein the water/sand slurry phase is removed from said cavity being mined into a previously mined cavity such that sand from said slurry settles to the bottom of said previously mined cavity and said water, along with entrained bitumen/diluent and fine sand not settled are cycled from said previously mined cavity to surge tank means where entrained bitumen/diluent is phase separated from said water in said tank and removed, fine sand entrained in said water is removed along with a portion of said water and wherein the remainder of said water is withdrawn from said tank, mixed with makeup water, diluent and reheated and pressurized to the initial high temperature and pressure and reinjected back into said water/diluent inlet channel.

6. A method according to claim 5 wherein the temperature of said water/diluent injected into said water/diluent inlet channel is between about 150 and 300° F.

7. A method according to claim 6 wherein the pressure of said water/diluent passing through said nozzles as a jet into said cavity being mined is between about 100 and 1000 psig.

8. A method according to claim 7 wherein said aggregate in said cavity being mined has a size of between about 0.5 to 1.5 inches.

9. A method according to claim 8 wherein the angle at which the water/diluent jets pass through said nozzles and impinge on the aggregate is such that the aggregate is caused to move outwardly from said nozzles along the floor of said cavity being mined and then in a circulatory motion upwardly, backwardly and downwardly through said water phase back toward the floor of said cavity being mined where said aggregate is again impinged upon by said jets.

10. A method according to claim 9 wherein heat loss between the hot water/diluent entering through inlet channel and the water/sand slurry phase withdrawn from said slurry exit channel is minimized by means of a thin walled tube around said slurry exit tube forming an annulus containing an insulating medium.

11. A method for the hydraulic removal of bitumen from a tar sand deposit located beneath surface overburden comprising:

a) forming a borehole through said overburden into the tar sand deposit;

b) affixing a casing into the borehole said casing having a proximal end above the grade of said surface overburden and extending downward through said overburden into said tar sand deposit and terminating at a distal end, said casing having a central opening at said proximal end through which a mining tool may be inserted and having aggregate entry means and bitumen/diluent removal means adjacent said proximal end above grade through which aggregate material may be added to the casing interior and from which bitumen/diluent may be removed from said casing;

c) inserting into said casing a mining tool comprising concentric inner and outer tubes, each having generally cylindrical walls and proximal and distal ends with the proximal ends extending above grade and above the proximal end of said casing, the interior of said inner tube forming a water/diluent inlet channel, the annular space between said inner and outer tubes forming an annular slurry outlet channel and the space between said outer tube and said casing further forming an annular mining cavity access channel, i) said inner tube having connecting means at its proximal end above said casing for conveying a water/diluent mixture into said water/diluent inlet channel said inner tube terminating in a distal floor and having disposed in the tubular wall just above said distal floor outwardly extending high pressure nozzles in fluid communication with said water/diluent intake channel for injecting jets of hot water/diluent passing through said water/diluent intake channel into a tar sand deposit;

ii) said outer tube having connecting means at its proximal end above said casing for conveying a slurry out of said mining tool, said outer tube having an annular distal floor closing said annular slurry channel at a position proximal of said high pressure nozzles in said cylindrical wall of said hot water/diluent tube the cylindrical wall of said outer tube further containing intake grates just above said annular distal floor for allowing entry of a slurry from a cavity being mined into said slurry outlet channel;

said mining tool extending through said casing and into said borehole such that said intake grates and high pressure nozzles are in said tar sand deposit;

d) adding aggregate through said aggregate entry means sufficient to cover said intake grates of said inner tube;

e) alternately rotating said mining tool horizontally over at least 180° rotation while injecting into said inner tube, under high temperature and pressure, a water/diluent mixture causing said water/diluent mixture to pass through said water/diluent inlet channel and out said nozzles as jets under high pressure and temperature such that a cavity is formed in said tar sand deposit by the temperature of the hot water softening the tar sand deposit and the force of the water jets and impact of the aggregate scouring the tar sand to remove tar sand from a developing floor and walls of a water filled cavity being formed in the deposit such that the bitumen in the tar sand interacts with the diluent present in the hot water lowering the viscosity of the bitumen and separating it from the sand particles such that the bitumen/diluent rises to the surface of the water in the cavity thereby forming a bitumen/diluent upper phase and a water/sand slurry phase at the bottom of the water filled cavity, removing bitumen/diluent phase through said bitumen/diluent removal means in said casing, withdrawing through said intake grates a sand/water slurry phase along with residual bitumen/diluent remaining in said water/sand slurry phase into said slurry channel and which passes upwardly and out of said mining tool for processing or disposal;

f) lowering said mining tool in said casing and borehole as the mining progresses such that the water/diluent jets passing through said nozzles is scouring the floor of the developing cavity in said tar sand deposit and adding such aggregate as is necessary to optimize the scouring action of the combination of aggregate and high pressure water/diluent jets.

12. A method according to claim 11 wherein attached to the distal floor of said inner tube and extending downwardly therefrom is a shaft to which is attached at its opposite end a drill hole plug, said plug having a diameter essentially the same as the borehole such that said shaft and plug extend into said borehole thereby preventing aggregate from filling said borehole and serving as a guide for said mining tool as it is progressively lowered in said borehole.

13. A method according to claim 12 wherein said mining tool is lowered at a rate such that said jets of water/diluent continuously impinge on the aggregate and the tar sand at the floor of the cavity being mined such that the tar sand at said floor is heated and removed from the floor surface by the combined grinding action of the impinged aggregate and jets of water/diluent.

14. A method according to claim 13 wherein the rate, pressure and temperature of the water/diluent passing through said nozzles into said cavity determine the rate at which the mining tool is lowered.

15. A method according to claim 14 wherein the sand/water slurry phase is removed from said cavity being mined into a previously mined cavity such that sand from said slurry settles to the bottom of said previously mined cavity and said water, along with entrained bitumen/diluent and fine sand not settled are cycled from said previously mined cavity to surge tank means where entrained bitumen/diluent is phase separated from said water in said tank and removed, fine sand entrained in said water is removed along with a portion of said water and wherein the remainder of said water is withdrawn from said tank, mixed with makeup water, diluent and reheated and pressurized to the initial high temperature and pressure and reinjected back into said water/diluent inlet channel.

16. A method according to claim 15 wherein the temperature of said water/diluent injected into said water/diluent inlet channel is between about 150 and 300° F.

17. A method according to claim 16 wherein the pressure of said water/diluent jets passing through said nozzles into said cavity being mined is between about 100 and 1000 psig.

18. A method according to claim 17 wherein said aggregate in said cavity being mined has a size of between about 0.5 to 1.5 inches.

19. A method according to claim 18 wherein the angle at which the water/diluent jets pass through said nozzles and impinge on the aggregate is such that the aggregate is caused to move outwardly from said nozzles along the floor of said cavity being mined and then in a circulatory motion upwardly, backwardly and downwardly through said water phase back toward the floor of said cavity being mined where said aggregate is again impinged upon by said jets.

20. A method according to claim 19 wherein heat loss between the hot water/diluent entering through said water inlet channel and the water/sand slurry phase withdrawn from said annular slurry outlet channel is minimized by means of a thin walled tube around said water inlet tube forming an annulus containing an insulating medium.

* * * * *